US006905088B2

(12) United States Patent
Alson

(10) Patent No.: US 6,905,088 B2
(45) Date of Patent: Jun. 14, 2005

(54) CABLE-WINDER DEVICE

(75) Inventor: Frankie Alson, Hong Kong (HK)

(73) Assignee: SDG Industries Limited, Kowloon (HK)

( * ) Notice: Subject to any disclaimer, the term of this patent is extended or adjusted under 35 U.S.C. 154(b) by 0 days.

(21) Appl. No.: 10/389,796

(22) Filed: Mar. 18, 2003

(65) Prior Publication Data

US 2003/0209625 A1 Nov. 13, 2003

(30) Foreign Application Priority Data

Mar. 22, 2002 (FR) ..... 02 03591

(51) Int. Cl.[7] ..... B65H 75/40

(52) U.S. Cl. ..... 242/401; 242/406; 242/398; 242/400

(58) Field of Search ..... 242/401, 406, 242/398, 400, 902; 312/258, 235.4, 235.5, 902, 237; 197/188.08, 188.01, 217.3, 423.39; 191/12.2 R, 12.2 A, 12.4

(56) References Cited

U.S. PATENT DOCUMENTS

| | | | | | |
|---|---|---|---|---|---|
| 115,109 | A | * | 5/1871 | Saurman | 242/400 |
| 308,431 | A | * | 11/1884 | Quayle | 312/902 |
| 1,142,039 | A | * | 6/1915 | Holcomb | 242/400 |
| 1,858,539 | A | * | 5/1932 | Dewey | 312/902 |
| 3,493,102 | A | * | 2/1970 | Belokin | 312/902 |
| 4,458,963 | A | * | 7/1984 | Keddie | 312/237 |
| 5,339,956 | A | * | 8/1994 | Thomason | 206/372 |
| 6,145,780 | A | * | 11/2000 | Fontana | 242/588.1 |
| 6,375,115 | B1 | * | 4/2002 | Reed | 242/594.4 |

FOREIGN PATENT DOCUMENTS

| | | | |
|---|---|---|---|
| DE | 3111443 | | 3/1981 |
| DE | 3322588 | | 6/1983 |
| DE | 29613542 | | 8/1996 |
| FR | 2754526 | | 10/1996 |
| JP | 9-195653 | * | 7/1997 |
| JP | 10337680 | | 12/1998 |

* cited by examiner

*Primary Examiner*—John M. Jillions
(74) *Attorney, Agent, or Firm*—Clark & Brody

(57) ABSTRACT

The invention provides a cable-winder device comprising first and second hinged-together portions, the second portion having a housing for a cable winder. In an in-use position, the device is self-supporting can be used as a stool, for example. A liftable hatch can be provided to give access to one or more stowage compartments.

10 Claims, 2 Drawing Sheets

CABLE-WINDER DEVICE

The present invention relates to a portable device for winding a cable suitable for use, in particular on a worksite, as an electrical extension cord for feeding electricity to one or more pieces of equipment while also making it possible, after it has been used, for the cable to be wound appropriately.

BACKGROUND OF THE INVENTION

In practice, on a worksite, it is necessary not only to have a cable winder, but also a tool box, electrical appliances which are to be used, and possibly also a stool or a stepladder for gaining access to high parts of walls or to a ceiling.

In addition, conventional cable winders do not stand securely on the ground and they are generally laid flat in ill-conceived manner.

OBJECT AND SUMMARY OF THE INVENTION

An object of the present invention is to provide a cable-winder device that is functionally and/or ergonomically improved.

The invention thus provides a cable-winder device comprising first and second hinged-together portions, one of the portions having a housing for a cable winder.

In one embodiment, improved positioning on the ground is achieved because the first and second portions are hinged between a stowage position in which the first and second portions are in abutment against each other, and an in-use position in which the first and second portions are spread apart from each other and present ground-engaging support faces for resting on the ground so that in its in-use position, the device is self-supporting.

In its in-use disposition, the device advantageously presents a top surface that is plane and made up of one or two portions.

In the in-use disposition, it is advantageous for said support faces to form a plane surface, thus providing a stable position on the ground.

In particular, it is advantageous for the device to be suitable for use as a stool when it is in its in-use position.

The cable winder can be placed in a front face of the second portion. In a side face adjacent to said front face, the second portion may include a housing for receiving an electrical plug for making a connection with the cable winder.

The article can be made more useful by the first portion and/or the second portion presenting at least one stowage compartment.

The first portion and/or the second portion may present at least one liftable hatch giving access to at least one such stowage compartment.

At least a top face of the first and/or second portion may present an opening enabling the device to be held in the hand. Advantageously, this opening defines a housing making it possible to grip the device about the hinge between the first and second portions.

BRIEF DESCRIPTION OF THE DRAWINGS

Other characteristics and advantages of the invention appear better on reading the following description which is given by way of non-limiting example and with reference to the accompanying drawings, in which.

MORE DETAILED DESCRIPTION

Figure 1:
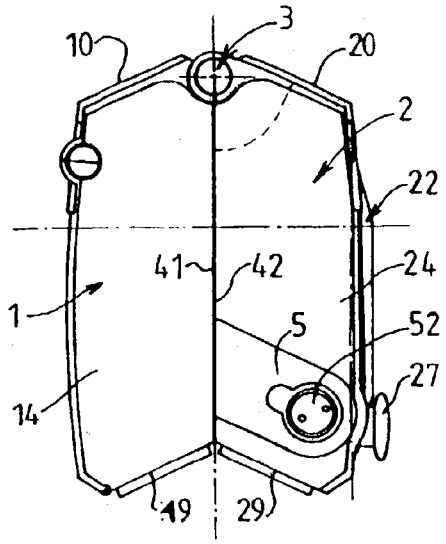
FIG. 1 is a side view of an embodiment of a device of the invention in its stowage position.

As shown in FIG. 1, the device comprises two main portions referenced 1 and 2 which are hinged together at 3 between their top faces 10 and 20 which are advantageously plane. In the stowage position as shown in FIG. 1, the first and second portions 1 and 2 come into abutment against each other via their respective inside faces 41 and 42.

Figure 2A:
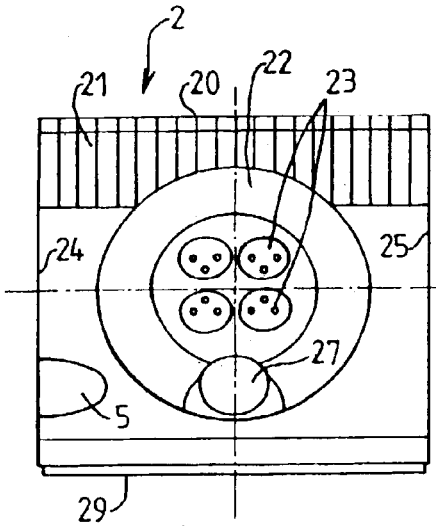
FIGS. 2*a* and 2*b* are respectively a left-hand front view and a side view of the FIG. 1 device in its in-use position, with FIG. 3*a* showing the device in its in-use position with a liftable hatch shown open so as to reveal at least one stowage compartment, and with FIG. 3*b* being a section on CC of FIG. 3*a*.
Figure 2B:
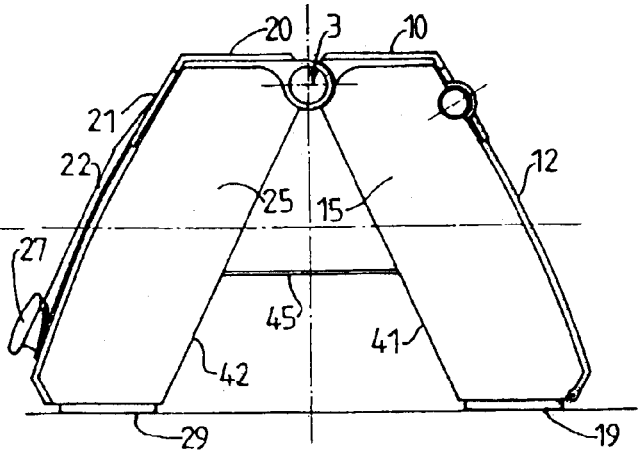

In the in-use position shown in FIGS. 2*a* and 2*b*, the first and second portions 1 and 2 are spaced apart by pivoting about the hinge 3 such that the plane support faces 19 and 29 become coplanar, thus enabling the device to be stood on the ground. The second portion referenced 2 houses a cable winder 22 presenting a plurality of electrical receptacles 23, in which case four receptacles, together with a handle 27 enabling the winder to be rotated for winding the cable in and out. The cable winder 22 may be of a commercially-available type. In addition, as shown in FIG. 2*b*, the top faces 10 and 20 are coplanar and an element 45 such as blocking rod or brace serves to limit relative angular movement between the portions 1 and 2. Insofar as the housing constituting the portions 1 and 2 are made of a material of sufficient thickness, when the device is in its deployed position for use, it can also serve as a stool for a user who can stand on the device, with the top faces 10 and 20 serving to support the user's feet. In particular, the portions 1 and 2 may be made of molded plastics material. The presence of the winder 22 contributes to its mechanical strength.

Figure 3A:
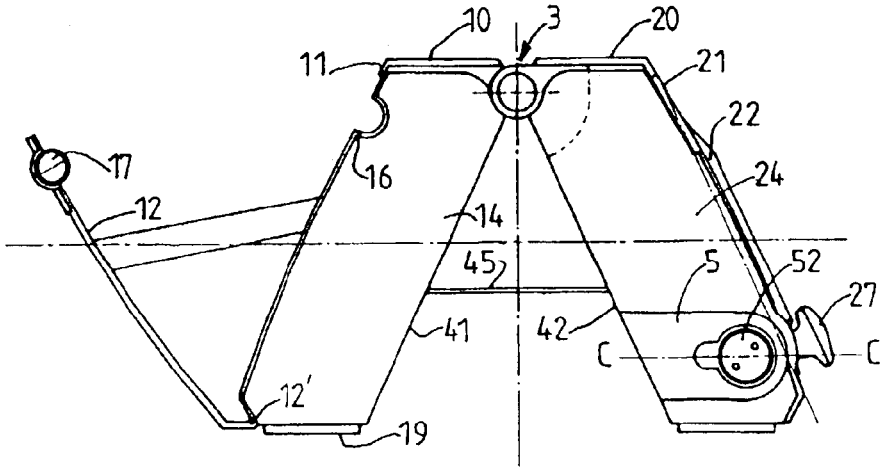

FIG. 3*a* shows firstly the cable winder 22 projecting form the front face 21 of the second portion 2, and secondly a liftable hatch 12 hinged at 14 that enables the front face 11 of the first portion 1 to be open, thereby revealing one or more stowage compartments that are made available inside the first portion 1, e.g. surrounded by the side panels 14 and 15 and by an end wall panel 41. The pivoting panel 12 can be locked about the axis 12' in simple manner, for example by means of elements 16 and 17 of matching shapes situated on either side of the panel (see FIG. 4*a*) and suitable for being engaged in one another on the application of a small amount of force.

Figure 3B:
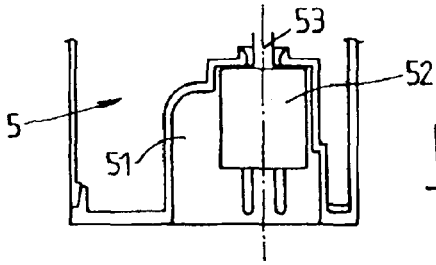

FIG. 3*a* and the section CC of FIG. 3*b* show more particularly under overall reference 5 the plug 52 for connecting the cable winder to the mains electricity supply, which plug is connected to one end of the cable 53 of the winder 22, and is received in a housing 51 so as to avoid projecting beyond the side wall 24 opposite from the side wall 25 of the second portion 2 of the device, thus enabling electrical connection to be achieved easily and also enabling the device to be stowed conveniently after use.

Figure 4A:
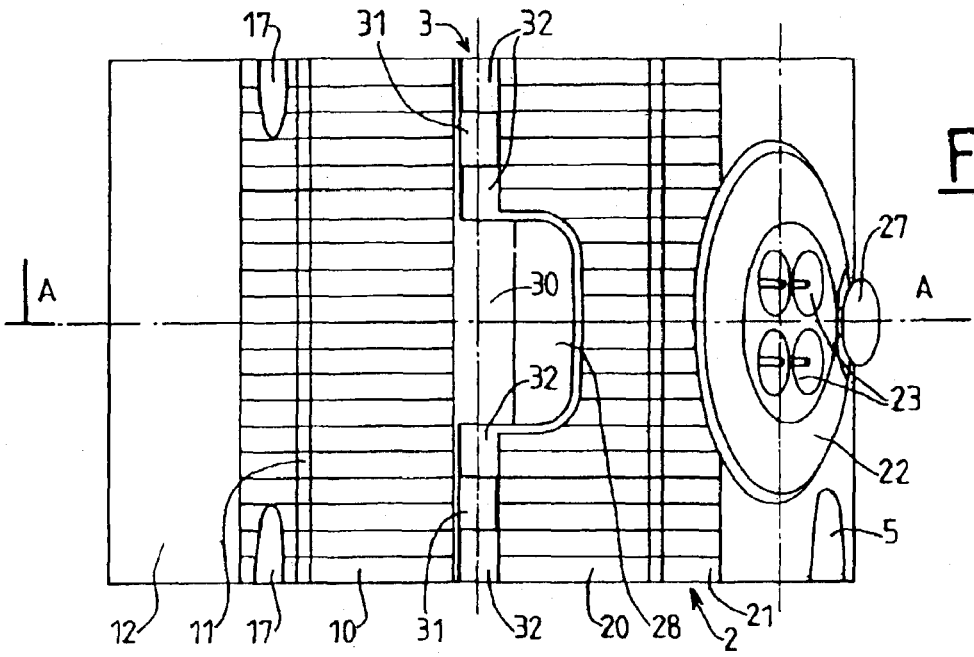
FIGS. 4*a* and 4*b* are respectively a plan view and a section view on AA of the device of the invention in its in-use position.
Figure 4B:
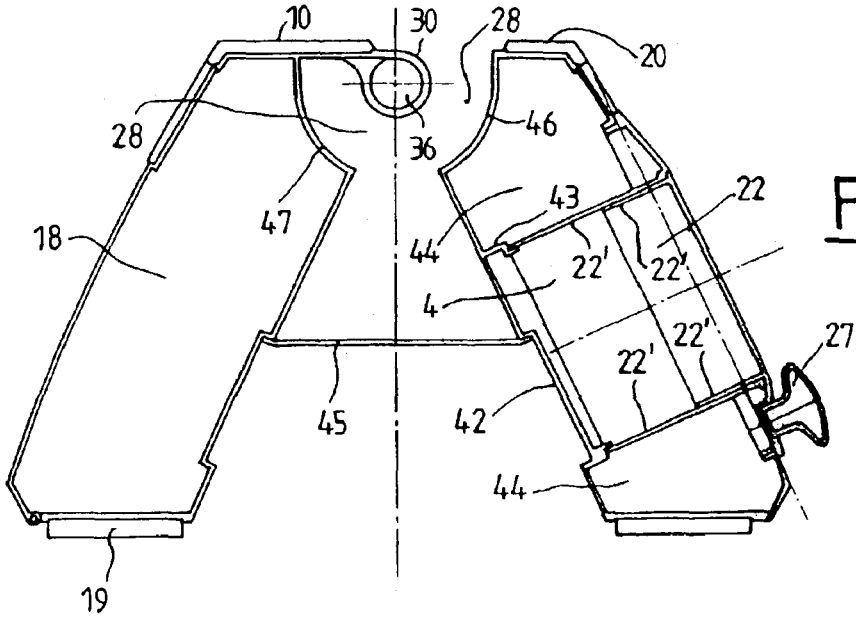

With reference to FIGS. 4*a* and 4*b*, it can be seen that in the preferred embodiment shown therein, the hinge 3 is made up firstly of cylinders 30 and 31 secured to the first portion 1 and engaged between cylinders 32 (in this case four cylinders) secured to the second portion 2. A shaft 36 is received in these cylinders while they are in alignment and act as a hinge pin.

In addition, a housing 28 defined by two cylindrical portions 46 and 47 is provided in the top face 20 and occupies approximately 180° (in the in-use position) so as to join in non-through manner the top face 10 to which the cylinder 30 is secured. As a result, the user can insert a hand and make use of the cylinder 30 as a handle for the device, both when it is in the open position as shown in FIG. 4*b* and when it is in the closed position as shown in FIG. 1. To make the device easier to grip, the diameter of the cylinder 30 is made to be larger than that of the other cylinders 31 and 32 mentioned above.

In addition, FIG. 4*b* shows the cable winder 22 whose cylindrical hub 22' comes into abutment at 43 against an end wall 42. A housing 44 of substantially annular shape serves to receive the cable 53 of the cable winder 22. Any space that is left available around the winder 22 can be used for providing one or more stowage compartments.

What is claimed is:

1. A cable-winder device, comprising first and second portions, wherein at least the first portion comprises at least one stowage compartment, and the second portion comprises a housing for a cable winder, and wherein said first and second portions are pivotally connected together to rotate about a pivot axis between a stowage position in which the first and second portions are in abutment against each other, and a use position in which the first and second portions are spaced apart from each other, and said first and second portions comprise support faces oriented to engage the ground simultaneously when said first and second portions are in the use position to make the device self-supporting, wherein, said first and second portions comprise upper faces that together form a flat top surface capable of engaging a user's foot when said first and second Portions are in said use position.

2. A device according to claim 1, wherein the cable winder is received in a front face of the second portion.

3. A device according to claim 2, wherein the second portion includes a housing in a side face adjacent to said front face, the housing receiving an electrical plug for making a connection with the cable winder.

4. A device according to claim 1, wherein the first and/or second portion presents at least one liftable hatch giving access to at least one said stowage compartment.

5. A device according to claim 1, wherein a top face of the first and/or second portions presents an opening enabling the device to be held in the hand.

6. A device according to claim 1 wherein is said use position said support faces form a plane surface.

7. A cable-winder device, comprising first and second portions, wherein at least the first portion comprises at least one stowage compartment, and the second portion comprises a housing for a cable winder, and wherein said first and second portions are pivotally connected together by a hinge to rotate about a pivot axis between a stowage position in which the first and second portions are in abutment against each other, and a use position in which the first and second portions are spaced apart from each other, and said first and second portions comprise support faces oriented to engage the around simultaneously when said first and second portions are in the use position to make the device self-supporting, wherein a top face of the first and/or second portions presents an opening enabling the device to be held in the hand, and wherein said opening defines a housing enabling the hinge between the first and second portions to be gripped at least in the stowage position.

8. A cable-winder device, comprising first and second portions, wherein at least the first portion comprises at least one stowage compartment, and the second portion comprises a housing for a cable winder, and wherein said first and second portions are pivotally connected together to rotate about a pivot axis between a stowage position in which the first and second portions are in abutment against each other, and a use position in which the first and second portions are spaced apart from each other, and said first and second portions comprise support faces oriented to engage the ground simultaneously when said first and second portions are in the use position to make the device self-supporting, wherein a respective said support face and a respective upper face of each of said first and second housings are parallel.

9. A device according to claim 8 wherein said first and second portions comprise housings connected to each other by a hinge.

10. A device according to claim 9, wherein, said first and second portions comprise upper faces that together form a flat top surface capable of engaging a user's foot when said first and second portions are in said use position.

* * * * *